US008705774B2

(12) United States Patent
Jilani et al.

(10) Patent No.: US 8,705,774 B2
(45) Date of Patent: Apr. 22, 2014

(54) ACOUSTIC PRESSURE TRANSDUCER

(75) Inventors: Adel Jilani, Corvallis, OR (US); James McKinnell, Salem, OR (US); Brian Homeijer, Corvallis, OR (US); Jennifer Wu, Corvallis, OR (US); Melinda Valencia, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 129 days.

(21) Appl. No.: 13/123,040

(22) PCT Filed: Jan. 14, 2009

(86) PCT No.: PCT/US2009/030975

§ 371 (c)(1), (2), (4) Date: Apr. 7, 2011

(87) PCT Pub. No.: WO2010/082925

PCT Pub. Date: Jul. 22, 2010

(65) Prior Publication Data

US 2012/0027236 A1 Feb. 2, 2012

(51) Int. Cl.
*H04R 25/00* (2006.01)

(52) U.S. Cl.
USPC ..... 381/152; 381/190; 381/431

(58) Field of Classification Search
USPC ..... 381/173, 175, 179, 190–191, 152, 431; 310/311, 314, 328; 367/180
See application file for complete search history.

(56) References Cited

U.S. PATENT DOCUMENTS

| | | | | |
|---|---|---|---|---|
| 4,182,937 | A * | 1/1980 | Greenwood | 381/162 |
| 4,672,853 | A * | 6/1987 | Hickox | 73/708 |
| 4,761,582 | A | 8/1988 | McKee | |
| 5,648,618 | A * | 7/1997 | Neukermans et al. | 73/862.08 |
| 6,568,052 | B1 | 5/2003 | Rife | |
| 6,577,742 | B1 | 6/2003 | Bruney | |
| 7,392,716 | B2 * | 7/2008 | Wilner | 73/862.627 |
| 2003/0051323 | A1 | 3/2003 | Gururaja | |
| 2006/0215874 | A1 * | 9/2006 | Jiles et al. | 381/417 |
| 2007/0063619 | A1 * | 3/2007 | Dewa et al. | 310/328 |
| 2007/0113658 | A1 | 5/2007 | Combi et al. | |
| 2007/0230722 | A1 | 10/2007 | Mori et al. | |
| 2007/0263886 | A1 * | 11/2007 | Starnes et al. | 381/190 |
| 2008/0137884 | A1 | 6/2008 | Kim et al. | |

FOREIGN PATENT DOCUMENTS

| | | |
|---|---|---|
| EP | 0727259 | 8/1996 |
| JP | 10-108297 | 4/1998 |
| JP | 200872703 A | 3/2008 |

* cited by examiner

*Primary Examiner* — Suhan Ni

(57) ABSTRACT

Acoustic transducer means are provided. A monolithic semiconductor layer defines a plate, a pair of oppositely disposed torsional hinges, a flexible extension and at least a portion of a support structure. Acoustic pressure communicated to the plate results in tensile strain of the flexible extension. The flexible extension provides a varying electrical characteristic responsive to the tensile strain. An electric signal corresponding to the acoustic pressure can be derived from the varying electrical characteristic of the flexible extension.

14 Claims, 7 Drawing Sheets

ACOUSTIC PRESSURE TRANSDUCER

BACKGROUND

Acoustic energy propagates through physical media in the form of waves. Such acoustic energy is commonly referred to as sound when the propagating frequency is within the human hearing range. Electronic detection of acoustic energy is germane to numerous areas of technical endeavor, including sound recording, sonar, health sciences, and so on.

A microphone is a transducer that exhibits some electrical characteristic that varies in accordance with the acoustic energy incident thereto. Such a varying electrical characteristic is, or is readily convertible to, an electrical signal that emulates the amplitude, frequency and/or other aspects of the detected acoustic energy.

Accordingly, the embodiments described hereinafter were developed in the interest of improved microphone design.

BRIEF DESCRIPTION OF THE DRAWINGS

The present embodiments will now be described, by way of example, with reference to the accompanying drawings, in which.

DETAILED DESCRIPTION

Introduction

Means and operating methods for microphones and other acoustic transducers are provided by the present teachings. A plate pivots about torsional hinges under the influence of acoustic pressure. A flexure extends away from the plate and is subject to tensile strain as a result of the acoustic pressure. The flexure supports one or more sensors, or is doped or otherwise configured to exhibit a varying electrical characteristic responsive to the tensile strain. An electric signal corresponding to the acoustic pressure is derived from the varying electrical characteristic exhibited by the flexure.

In one embodiment, an apparatus includes a flexure layer that defines a plate and a first hinge portion and a second hinge portion. The flexure layer also defines a flexible portion that extends away from the plate. The flexible portion is configured to exhibit an electrical characteristic that varies in response to an acoustic pressure.

In another embodiment, a transducer includes a flexure layer of monolithic material. The flexure layer defines a plate, as well as a first torsional hinge portion and a second torsional hinge portion. The first and second torsional hinge portions extend away from opposite sides of the plate. The flexure layer also defines a flexible extension portion. The transducer also includes a spine layer that covers the plate of the flexure layer. The transducer further includes a membrane layer that covers the spine layer. The flexible extension portion is configured to exhibit an electrical characteristic varying in accordance with an acoustic pressure incident to the membrane layer.

In yet another embodiment, a method includes displacing a flexure layer of a transducer by influence of an acoustic pressure. The displacing includes torsional strain of a pair of hinge portions, and tensile strain of a flexible extension. The method also includes varying an electrical characteristic of the flexible extension in accordance with the tensile strain. The method further includes deriving an electrical signal corresponding to the acoustic pressure by using the varying electrical characteristic.

First Illustrative Embodiment

Figure 1:
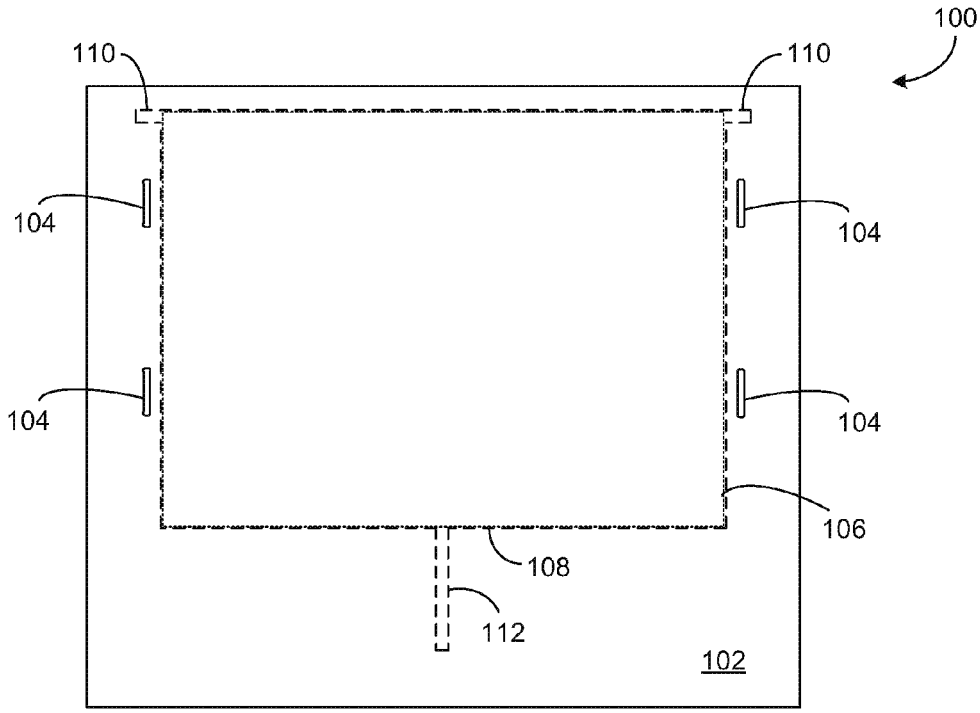
FIG. 1 depicts a plan view of a microphone according to one embodiment.
Figure 1A:
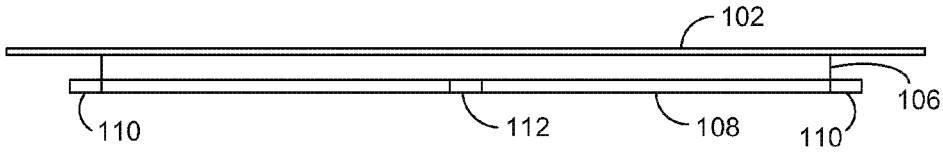
FIG. 1A depicts a front elevation view of the microphone of FIG. 1.
Figure 1B:
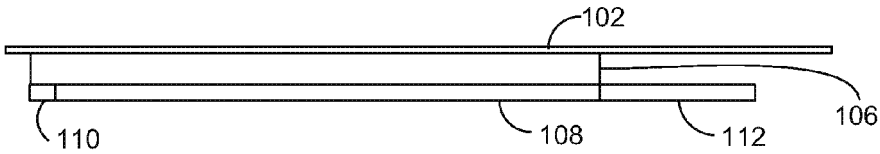
FIG. 1B depicts a side elevation view of the microphone of FIG. 1.

FIG. 1 depicts a plan view of a microphone element (microphone) 100 according to one embodiment. Simultaneous reference is also made to FIGS. 1A and 1B, which depict a front elevation view and a side elevation view of the microphone 100, respectively. The microphone 100 includes a plate (or membrane) 102. The membrane 102 can be formed from any suitable, semi-flexible material such as, for non-limiting example nickel, tantalum aluminum alloy, silicon nitride, silicon oxide, silicon oxy-nitride, Si, SU-8, etc. Other materials can also be used. The membrane 102 is disposed to have acoustic energy (e.g., sound waves, etc.) incident there upon during typical operation of the microphone 100.

The membrane 102 is formed so as to define a plurality of through apertures, or vents, 104. Each of the vents 104 is configured to permit the passage of ambient gas (e.g., air, etc.) there through during typical operation of the microphone 100. Further elaboration on the operation of the microphone 100 is provided hereinafter.

The microphone 100 also includes a spine (layer) 106. The spine 106 is bonded to and generally underlies the membrane 102. The spine 106 can be formed from any suitable material. In a typical embodiment, the spine layer 106 is formed from silicon, silicon oxide or another suitable material. In any case, the spine 106 is configured to provide additional structural rigidity and strength to the microphone 100.

The microphone 100 further includes a flexure layer 108. The flexure layer 108 is formed from any suitable material such as silicon, a semiconductor material, etc. Other materials can also be used. The flexure layer 108 is configured to define a pair of hinge portions 110. The hinge portions 110 are disposed on, and extend away from, opposite sides of the flexure layer 108. In turn, the hinge portions 110 define an axis about which the bulk of the flexure layer 108 torsionally pivots or shifts under the influence of acoustic pressure incident to the membrane 102. The hinge portions 110 can also be referred to as torsional hinge portions 110.

The flexure layer 108 is further configured to define a flexible extension portion 112. The flexible extension portion, or flexure, 112 extends away from the flexure layer 108 in a direction perpendicular to the axis defined by the hinge portions 110. The flexure 112 is configured to flexibly strain under the influence of acoustic pressure incident to the membrane 102. The strain is then transferred to one or more sensors (not shown in FIGS. 1-1B) which exhibit a varying electrical characteristic in response to the acoustic pressure. In another embodiment, the flexure 112 is doped or otherwise modified so as to exhibit piezoresistive or piezoelectric characteristics, and no discrete sensors as such are included. In any case, the electrical characteristic of the flexure 112 can be electrically coupled to other circuitry (not shown) such that an electrical signal corresponding to the acoustic pressure incident to the membrane 102 is derived.

The flexure layer 108 including the hinge portions 110 and the flexible extension 112 are typically—but not necessarily—formed from semiconductor such as silicon and are shaped using known techniques such as masking, etching, etc. The hinge portions 110 and the flexure 112 mechanically couple the flexure layer 108 to a surrounding support structure (not shown). In one or more embodiments, the support structure (not shown) and the flexure layer 108 (including hinges 110 and extension 112) are contiguous in nature, being etched, cut, or otherwise suitably formed from a monolithic layer of material.

The spine 106 is a continuous sheet or layer of material overlying and continuously bonded to a bulk area of the flexure layer 108. Thus, the spine 106 covers all but the hinge portions 110 and the flexure 112 of the flexure layer 108. In turn, the membrane 102 overlies and is continuously bonded to the spine 106. The membrane 102 is defined by an overall area that exceeds and extends outward from the area of the spine 106. Illustrative and non-limiting dimensions for an embodiment of microphone 100 are provided in Table 1 below (1 μM=$1\times10^{-6}$ Meters):

TABLE 1

| Element | Width | Length | Thickness |
|---|---|---|---|
| Membrane 102 | 1100 μM | 1080 μM | 1 μM |
| Spine 106 | 1000 μM | 1000 μM | 6 μM |
| Hinge 110 | 10 μM | 3 μM | 2 μM |
| Flexure 112 | 3 μM | 60 μM | 2 μM |

It is noted that a significant portion of the flexure layer 108 is of the same area dimensions as the overlying spine 106. This significant portion of the flexure layer 108 is referred to herein as a "plate area" or "plate" for the flexure layer 108.

Second Illustrative Embodiment

Figure 2:
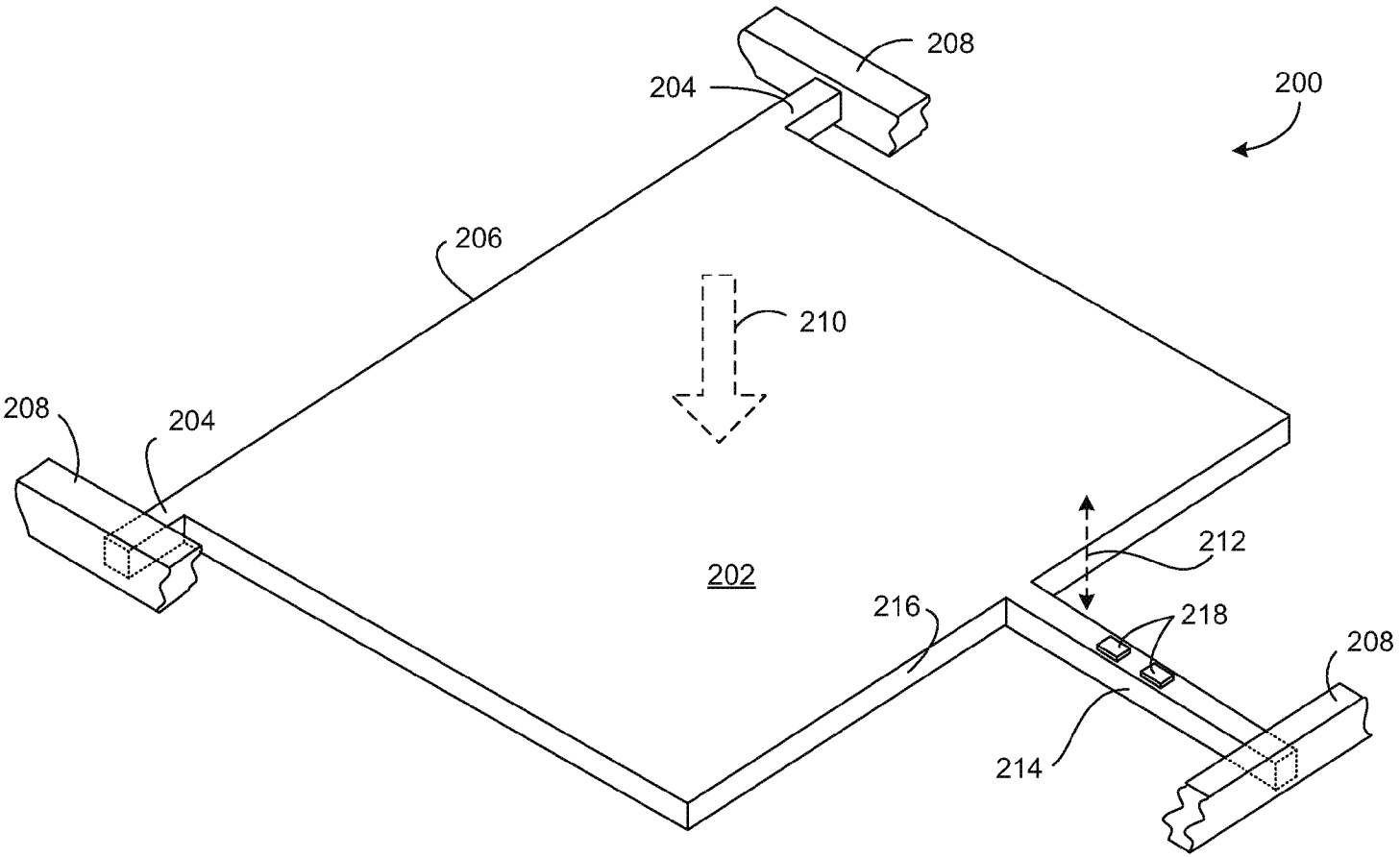
FIG. 2 depicts an isometric view a flexure layer according to one embodiment.

FIG. 2 depicts an isometric view of an illustrative and non-limiting flexure layer 200 according to one embodiment. The flexure layer 200 is understood to be part of a microphone (e.g., 100) including other elements (not shown) such as, for non-limiting example, a membrane (e.g., 102), a spine (e.g., 106), etc. Thus, the flexure layer 200 is a portion of a greater microphone construct according to the present teachings, and various associated elements are not shown in the interest of simplicity. The flexure layer 200 is formed from silicon such that an overall monolithic structure is defined as described hereinafter.

The flexure layer 200 defines a plate area (plate) 202. The plate 202 accounts for the bulk (i.e., material majority) of the flexure layer 200. The plate 202 is understood to be bonded to a spine layer of material (not shown) of corresponding area.

The flexure layer 200 defines a pair of oppositely disposed hinge portions 204. The hinge portions 204 are linear in form and extend away from the flexure layer 200 proximate an edge 206 of the plate 202. The hinge portions 204 are configured to mechanically couple the plate 202 to respective locations on a supporting structure 208, of which only fractional portions are shown. The hinge portions 204 are further configured to define a torsional pivot axis for the flexure layer 200 when the plate 202 is subjected to acoustic pressure 210. Acoustic pressure 210 is mechanically transferred to the flexure layer 200 by way of overlying membrane and spine elements (See FIGS. 1-1B). Such acoustic pressure 210 causes the flexure layer 200 to bidirectionally pivot or swing as indicated by double-arrow 212.

The flexure layer 200 also defines a flexible extension (or flexure) 214. The flexible extension 214 extends away from the flexure layer 200 at an edge 216 in a direction perpendicular to the torsional pivot axis defined by the hinge portions 204. The flexible extension 214 couples the plate 202 to the support structure 208. The flexible extension 214 is configured to exhibit tensile strain under the influence of acoustic pressure 210.

The flexible extension 214 supports a plurality of piezoresistive sensors 218. The piezoresistive sensors 218 are each configured to provide an electrical resistance (i.e., exhibit an electrical characteristic) that varies in accordance with acoustic pressure 210 transferred to the flexure layer 200. The corresponding electrical resistance is understood to be coupled to other electronic circuitry (not shown) for electrical signal derivation, amplification, filtering, digital quantization, signal processing, etc., as needed so that the detected acoustic pressure 210 can be suitably utilized.

A total of two piezoresistive sensors 218 are depicted in FIG. 2. In another embodiment, a different number of piezoresistive (or piezoelectric) sensors are used. In still another embodiment (not shown), the flexible extension has been doped or otherwise modified so to exhibit a piezoresistive, piezoelectric, or other electrical characteristic that varies in accordance with acoustic pressure incident (i.e., transferred) to the flexure layer.

During typical operation, acoustic pressure 210 is incident to a membrane that overlies and is mechanically coupled to the flexure layer 200. Please refer to FIGS. 1-1B for analogous illustration. The acoustic pressure 210 is understood to be defined by various characteristics including amplitude and frequency. Furthermore, the amplitude, frequency, and/or other characteristics of the acoustic pressure 210 may be essentially constant or time-varying. The membrane couples or transfers the acoustic pressure 210 to a spine that, in turn, transfers the acoustic pressure 210 to the plate 202 of the flexure layer 200.

The flexure layer 200 shifts in position by way of torsional strain of the hinge portions 204 and tensile strain of the flexible extension 214. The tensile strain of flexure 214 is further coupled to the two piezoresistive sensors 218, which respond by producing a correspondingly varying electrical resistance. The electrical resistance, or signal, is understood to be coupled to electronic circuitry (not shown) by wiring or other suitable conductive pathways.

The flexure layer 200 (including the plate 202, the hinge portions 204 and the flexure 214) and the supporting structure 208 are formed from a single layer of semiconductor material. Thus, the flexure layer 200 and the structure 208 are a monolithic structure formed by etching, cutting and/or other suitable operations. In a typical and non-limiting embodiment, the supporting structure essentially surrounds the plate 202 such that the plate 202 is suspended within a cavity by virtue of the hinge portions 204 and the flexure 214. Other configurations for supporting the plate 202 can also be used.

Third Illustrative Embodiment

Figure 3:
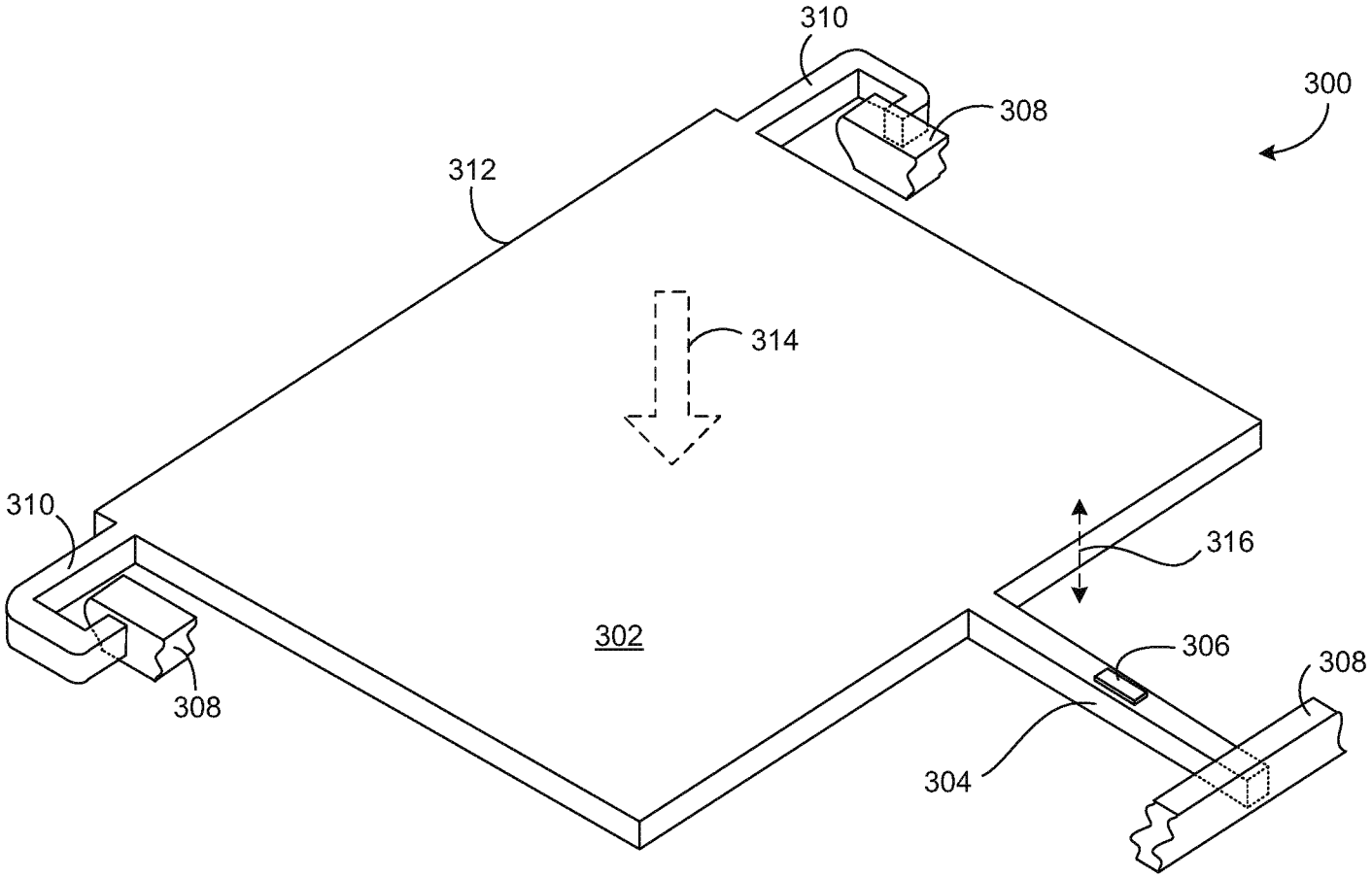
FIG. 3 depicts an isometric view a flexure layer according to another embodiment.

FIG. 3 depicts an isometric view of an illustrative and non-limiting flexure layer 300 according to one embodiment. The flexure layer 300 is understood to be part of a microphone (e.g., 100) including other elements (not shown) such as, for non-limiting example, a membrane (e.g., 102), a spine (e.g., 106), etc. Thus, the flexure layer 300 is a portion of a greater microphone construct according to the present teachings, and various associated elements are not shown in the interest of simplicity. The flexure layer 300 is formed from silicon such that an overall monolithic structure is defined as described hereinafter.

The flexure layer 300 includes a plate 302, a flexible extension (or flexure) 304, and a single piezoresistive sensor 306 substantially configured and operative as described above in regard to the plate 202, flexure 214 and piezoresistive sensor (s) 218 of flexure layer 200. Additionally, the flexure layer 300 is mechanically coupled to and supported by a support structure 308.

The flexure layer 300 is further configured to define a pair of curvilinear hinge portions 310. The hinge portions 310 are generally hook or "J" shaped and extend away from the flexure layer 300 proximate an edge 312 of the plate 302. The hinge portions 310 are configured to mechanically couple the plate 302 to respective locations on the supporting structure 308, of which only fractional portions are shown. The curvilinear shape of the hinge portions 310 accommodates thermal and/or residual stresses, protecting the plate 302 or the hinge portions 310 themselves against buckling, cracking or other structural damage.

The hinge portions 310 are further configured to define a torsional pivot axis for the flexure layer 300 when the plate 302 is subjected to acoustic pressure 314. Acoustic pressure 314 is mechanically transferred to the flexure layer 300 by way of overlying membrane and spine elements (See FIGS. 1-1B). Such acoustic pressure 314 causes the flexure layer 300 to bidirectionally pivot or swing as indicated by double-arrow 316.

During typical operation, acoustic pressure 314 is incident to a membrane that overlies and is mechanically coupled to the flexure layer 300. Please refer to FIGS. 1-1B for analogous illustration. The acoustic pressure 314 is understood to be defined by various characteristics, which may be essentially constant or time-varying, respectively. The membrane couples or transfers the acoustic pressure 314 to a spine that, in turn, transfers the acoustic pressure 314 to the plate 302 of the flexure layer 300.

The flexure layer 300 shifts in position by way of torsional strain of the curvilinear hinge portions 310 and tensile strain of the flexible extension 304. The tensile strain of flexure 304 is further coupled to the piezoresistive sensor 306, which responds by producing a correspondingly varying electrical resistance. The electrical resistance, or signal, is understood to be coupled to electronic circuitry (not shown) by wiring or other suitable conductive pathways.

The flexure layer 300 (including the plate 302, the hinge portions 310 and the flexure 304) and the supporting structure 308 are formed from a single layer of semiconductor material. Thus, the flexure layer 300 and the structure 308 are a monolithic structure formed by etching, cutting and/or other suitable operations. In a typical and non-limiting embodiment, the supporting structure essentially surrounds the plate 302 such that the plate 302 is suspended within a cavity by way of the hinge portions 310 and the flexure 304. Other configurations for supporting the plate 302 can also be used.

Fourth Illustrative Embodiment

Figure 4:
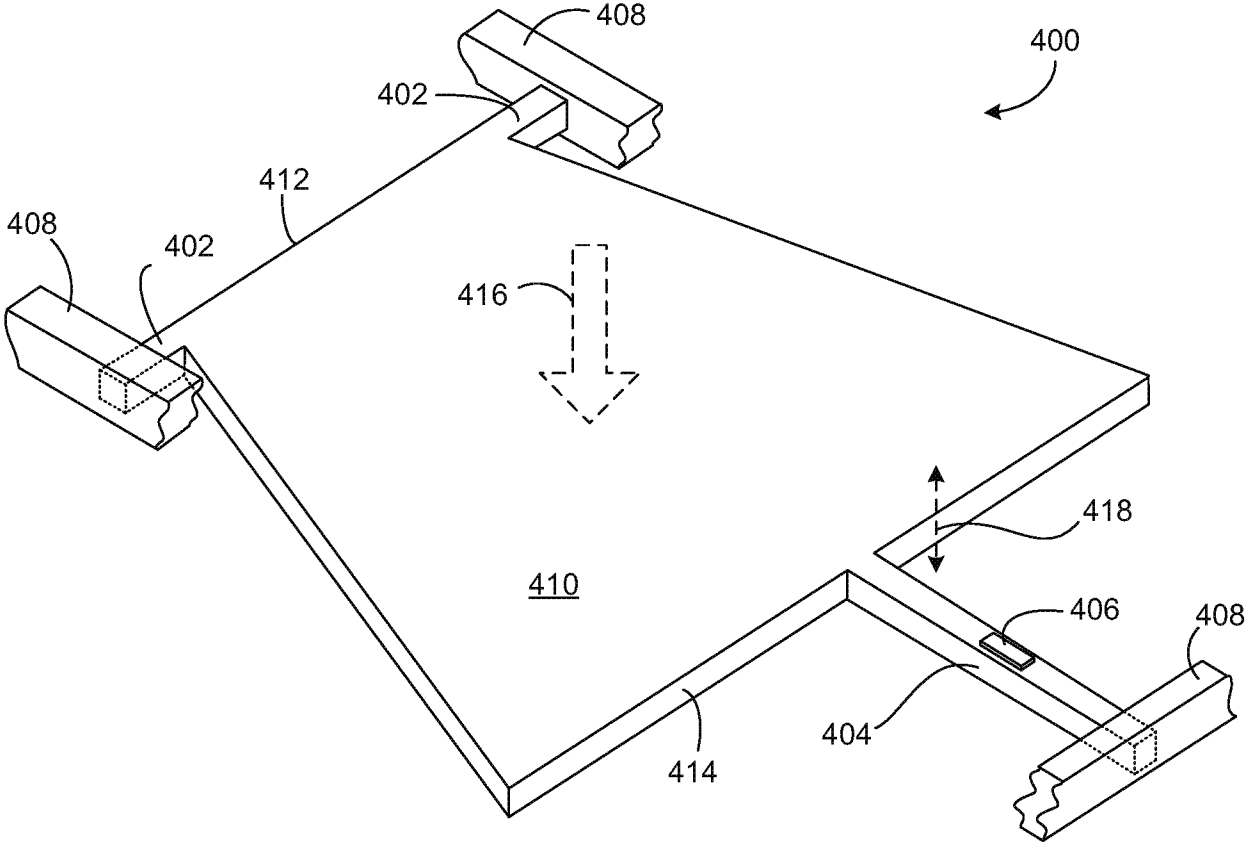
FIG. 4 depicts an isometric view a flexure layer according to still another embodiment.

FIG. 4 depicts an isometric view of an illustrative and non-limiting flexure layer 400 according to one embodiment. The flexure layer 400 is understood to be part of a microphone (e.g., 100) including other elements (not shown) such as, for non-limiting example, a membrane (e.g., 102), a spine (e.g., 106), etc. Thus, the flexure layer 400 is a portion of a greater microphone construct according to the present teachings, and various associated elements are not shown in the interest of simplicity. The flexure layer 400 is formed from silicon such that an overall monolithic structure is defined as described hereinafter.

The flexure layer 400 includes a pair of opposite, linear hinge portions 402, a flexible extension (or flexure) 404, and a single piezoresistive sensor 406 substantially configured and operative as described above in regard hinge portions 204, the flexure 214 and the piezoresistive sensor(s) 218 of flexure layer 200. Additionally, the flexure layer 400 is mechanically coupled to and supported by a support structure 408.

The flexure layer 400 is further configured to define a trapezoidal plate 410. The plate 410 includes a shorter edge 412 and a longer edge 414. Respective edges 412 and 414 are opposite and parallel to each other. The flexure 404 extends away from the longer edge 414 of the plate 410.

During typical operation, acoustic pressure 416 is incident to a membrane that overlies and is mechanically coupled to the flexure layer 400. Please refer to FIGS. 1-1B for analogous illustration. The membrane couples or transfers the acoustic pressure 416 to a spine that, in turn, transfers the acoustic pressure 416 to the plate 410 of the flexure layer 400.

The acoustic pressure 416 causes the flexure layer 400 to bidirectionally pivot or swing as indicated by double-arrow 418. In turn, the flexure layer 400 shifts in position by way of torsional strain of the hinge portions 402 and tensile strain of the flexible extension (flexure) 404. The tensile strain of flexure 404 is further coupled to the piezoresistive sensor 406, which responds by producing a correspondingly varying electrical resistance. The electrical resistance, or signal, is understood to be coupled to electronic circuitry (not shown) as desired.

The trapezoidal shape of the plate 410 having the longer edge 414 proximate to the flexure 404 results in increased sensitivity to acoustic pressure 416, relative to a plate area that is, for example, substantially square or rectangular in shape (e.g., plate 202 of FIG. 2, etc.). Thus, the present teachings contemplate numerous shapes for a flexure layer (and corresponding spine and/or membrane) in the interest of improving and/or optimizing one or more performance characteristics.

The flexure layer 400 (including the plate 410, the hinge portions 402 and the flexure 404) and the supporting structure 408 are formed from a single layer of semiconductor material. Thus, the flexure layer 400 and the structure 408 are a monolithic structure formed by etching, cutting and/or other suitable operations.

Fifth Illustrative Embodiment

Figure 5:
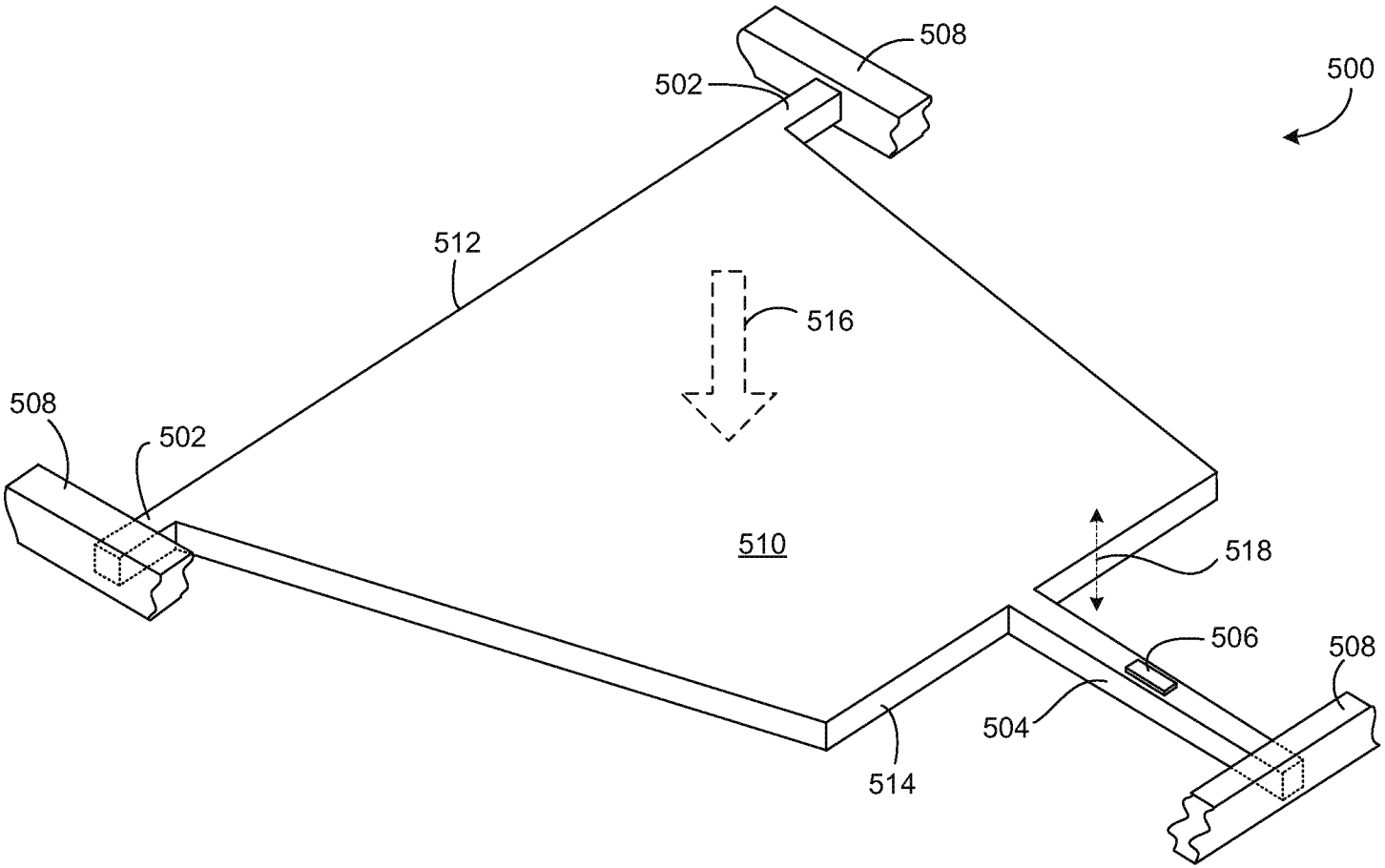
FIG. 5 depicts an isometric view a flexure layer according to yet another embodiment.

FIG. 5 depicts an isometric view of an illustrative and non-limiting flexure layer 500 according to one embodiment. The flexure layer 500 is understood to be part of a microphone (e.g., 100) including other elements (not shown) such as, for non-limiting example, a membrane (e.g., 102), a spine (e.g., 106), etc. Thus, the flexure layer 500 is a portion of a greater microphone construct according to the present teachings, and various associated elements are not shown in the interest of simplicity. The flexure layer 500 is formed from silicon such that an overall monolithic structure is defined as described hereinafter.

The flexure layer 500 includes a pair of opposite, linear hinge portions 502, a flexible extension (or flexure) 504, and a single piezoresistive sensor 506 substantially configured and operative as described above in regard to hinge portions 204, the flexure 214 and the piezoresistive sensor(s) 218 of flexure layer 200. Additionally, the flexure layer 500 is mechanically coupled to and supported by a support structure 508.

The flexure layer 500 is further configured to define a trapezoidal plate 510. The plate 510 includes a longer edge 512 and a shorter edge 514. Respective edges 512 and 514 are opposite and parallel to each other. The flexure 504 extends away from the shorter edge 514 of the plate 510.

During typical operation, acoustic pressure 516 is incident to a membrane that overlies and is mechanically coupled to the flexure layer 500. Please refer to FIGS. 1-1B for analogous illustration. The membrane couples or transfers the acoustic pressure 516 to a spine that, in turn, transfers the acoustic pressure 516 to the plate 510 of the flexure layer 500.

The flexure layer 500 shifts in position as indicated by double-arrow 518 by way of torsional strain of the hinge portions 502 and tensile strain of the flexure 504. The tensile strain of flexure 504 is further coupled to the piezoresistive sensor 506, which responds by producing a correspondingly varying electrical resistance. The electrical resistance, or signal, is understood to be coupled to electronic circuitry (not shown) as desired.

The trapezoidal shape of the plate 510, wherein the shorter edge 514 is proximate to the flexure 504, has been found to result in elimination of unwanted resonant modes, Numerous shapes for a flexure layer (and a corresponding spine and/or membrane) can be configured and used to improve, optimize and/or alter one or more performance criteria of the associated microphone.

The flexure layer 500 (including the plate 510, the hinge portions 502 and the flexure 504) and the supporting structure 508 are formed from a single layer of semiconductor material. Thus, the flexure layer 500 and the structure 508 are a monolithic structure formed by etching, cutting and/or other suitable operations.

Illustrative Operation

Figure 6:
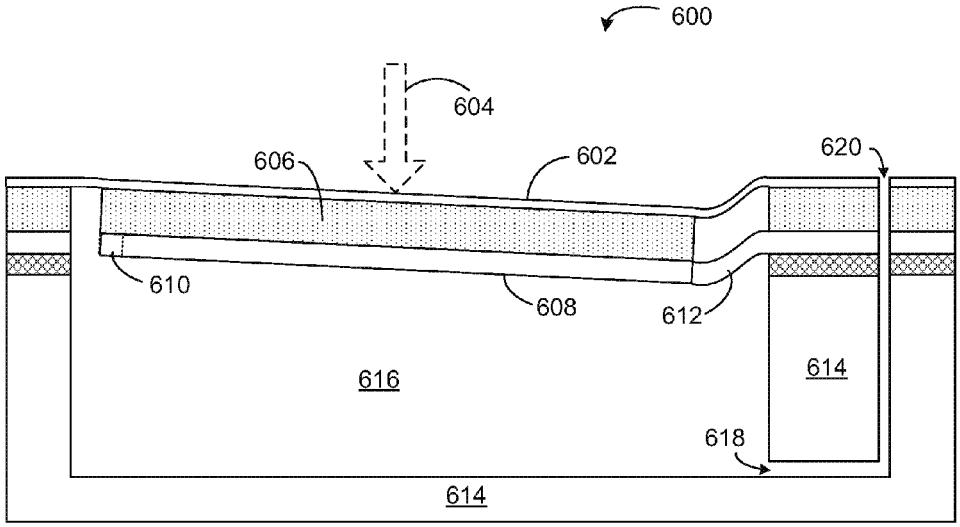
FIG. 6 depicts a side elevation sectional view of an illustrative microphone operation according to the present teachings.

FIG. 6 is a side elevation sectional view depicting a microphone element (microphone) 600 according to one embodiment under illustrative and non-limiting operating conditions. The microphone 600 includes a membrane 602. The membrane 602 is semi-rigid in nature, configured to flexibly deform (strain) under the influence of incident acoustic pressure 604 and return to a substantially planar resting state in the absence of acoustic pressure 604.

The microphone 600 also includes a spine layer 606 and flexure layer 608. The flexure layer 608 is configured (i.e., formed) to define a pair of torsional hinge portions 610 (only one hinge portion 610 shown) and a flexible extension or flexure 612. The membrane 602, the spine layer 606 and the flexure layer 608 are defined from corresponding layers of material by way of etching, cutting, and/or other suitable techniques known to one of ordinary skill in the semiconductor fabrication arts. The microphone 600 includes an underlying substrate 614 of silicon or other semiconductor material.

The respective material layers of the microphone 600 are formed such that an acoustic cavity 616 is defined. The acoustic cavity 616 is fluidly coupled to an ambient environment about the microphone 600 by way of a passageway 618 leading to a vent 620. In another embodiment, other passageways and/or vents can be used. Ambient gases (e.g., air, etc.) are permitted to pass in and out of the acoustic cavity 616 by way of the passageway 618 and vent 620 during normal operations of the microphone 600.

The flexure layer 608 is coupled to and supported by the surrounding material layer from which it is formed by way of the torsional hinge(s) 610 and the flexure 612. Additionally, the membrane 602 overlaps the spine layer 606 and the flexure layer 608, extending outward over at least a portion of the material layers of the microphone 600. In turn, the spine layer 606 is discretely defined apart from the material layer from which it is formed. In this way, the flexure layer 608 is generally suspended (i.e. supported) within the acoustic cavity 616.

As depicted, an acoustic pressure 604 is incident to the membrane 602. The acoustic pressure 604 is coupled to the flexure layer 608 by way of the spine 606. In response to the acoustic pressure 604, the microphone element 600 is pivotally displaced by way of torsional strain of the hinge portions 610 and tensile strain of the flexure 612, as well as flexure of the membrane 602.

The flexure 612 is understood to include (i.e., exhibit) an electrical characteristic that varies in accordance with the incident acoustic pressure 604. This characteristic can be piezoresistive and/or piezoelectric, and can be provided by way of one or more suitable sensors (not shown; see sensors 218 of FIG. 2) or doping or other treatment of the flexure 612. In any case, an electric signal corresponding to the acoustic pressure 604 is derived by way of the electrical characteristic of flexure 612.

Illustrative System

Figure 7:
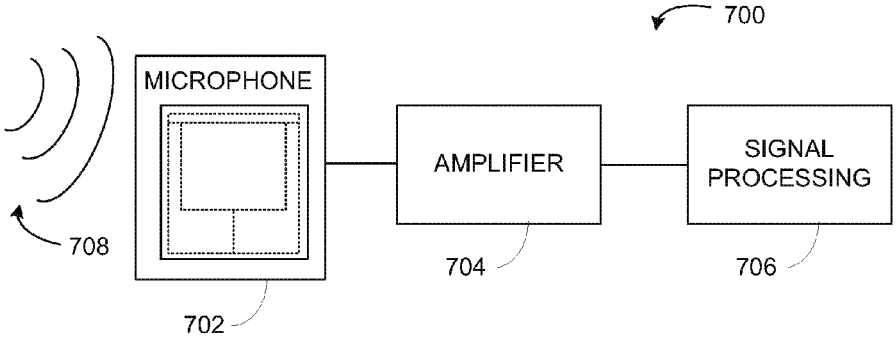
FIG. 7 depicts a block diagram of a system according to one embodiment.
Figure 8:
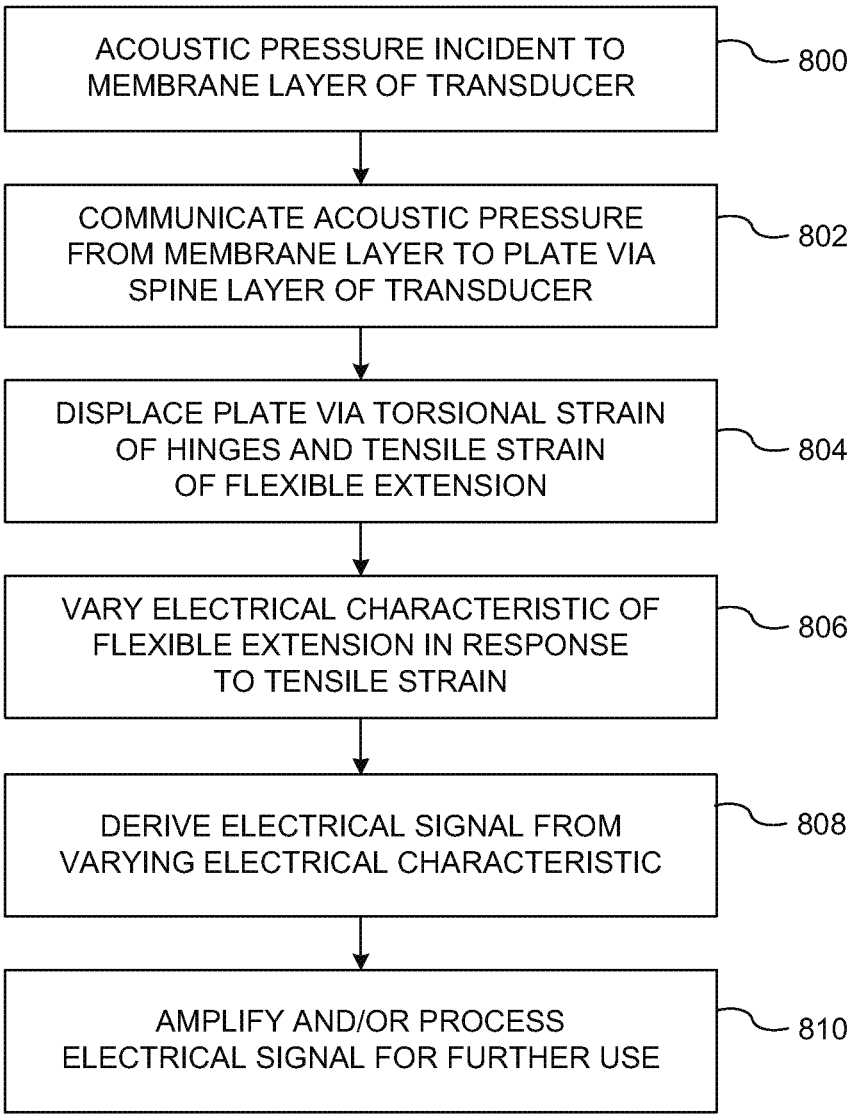
FIG. 8 depicts a flow diagram of a method according to one embodiment.

FIG. 7 is a block diagram depicting a system 700 according to another embodiment, while FIG. 8 is a flow diagram depicting a method according to the present teachings. The system 700 is depicted in the interest of understanding the present teachings and is illustrative and non-limiting in nature. Thus, numerous other systems, operating scenarios and/or environments can be used.

The system includes a microphone 702. The microphone 702 includes a membrane, spine and flexure layer according to the present teachings. For purposes of understanding, it is presumed that the microphone 702 includes elements consistent with those of the microphone 100 of FIG. 1. Other configurations according to the present teachings can also be used. The system 700 also includes an amplifier 704 and signal processing 706.

In typical operation, the microphone 702 provides an electric signal (i.e., a varying electrical characteristic) in response to incident acoustic energy 708 to the amplifier 704. The amplifier 704 increases the amplitude and/or power of the electric signal, which is then provided to the signal processing circuitry 706. In turn, the signal processing circuitry 706 digitally quantizes the amplified electric signal, filters the signal, identifies and/or detects particular content within the signal, etc., in accordance with any suitable signal conditioning that is desired. The processed signal can then be put to any suitable use as desired (e.g., recorded, displayed via an oscilloscope or other instrument, audibly produced by way of speakers, etc.). One having ordinary skill in the signal processing arts will appreciate that numerous processing steps can be performed once an electrical signal representative of the acoustic pressure 708 is derived, and further elaboration is not required for purposes of understanding the present teachings.

In one or more embodiments, a microphone (i.e., acoustic transducer) according to the present teachings is formed as a part of an integrated device. In such an embodiment, for example, amplification, signal processing, and/or other circuitry is formed along with microphone elements on a common substrate (or die). In this way, the present teachings can be incorporated as a part of numerous types of micro electromechanical machines (MEMS).

Illustrative Method

FIG. 8 is a flow diagram depicting a method according to another embodiment of the present teachings. FIG. 8 depicts particular operations and sequence of execution. However, the method of FIG. 8 is illustrative and non-limiting in nature, and other methods including other operations, omitting one or more operations shown, and/or proceeding in other sequences of execution can also be defined and used according to the present teachings. Reference is also made to FIG. 6 for purposes of illustration.

At 800, an acoustic pressure is incident to a membrane layer of a transducer (i.e., microphone) according to the present teachings. For purposes of non-limiting example, it is assumed that the acoustic pressure 604 is incident to a membrane 602 of a transducer.

At 802, the acoustic pressure, incident to the membrane layer, is communicated (i.e., mechanically coupled) to a plate portion of flexure layer of the transducer by way of an overlying spine layer. For purposes of the ongoing example, it is assumed that the acoustic pressure 604 is communicated to the plate defined by a flexure layer 608.

At 804, the plate is displaced by the acoustic pressure by way of torsional strain of the hinges (i.e., hinge portions) and tensile strain, or flexing, of the flexure. For example, it is assumed that the plate portion of the flexure layer 608 is displaced (or tilted) downward due to torsional twisting of the hinges 610 and flexing of the flexure 612.

At 806, an electrical characteristic of the flexible extension vary (or change) in accordance with the tensile strain of the flexure. Under the ongoing example, piezoresistive doping of the flexure 612 reacts to the flexing by changing its electrical resistance away from a nominal, resting ohmic value. The change in resistance (or other electrical attribute) corresponds in frequency and amplitude to that of the acoustic pressure 604.

At 808, an electrical signal is derived from the varying electrical characteristic of the flexible extension. Under example, the changing resistance of the flexure 612 is electrically excited by a source of energy so as to derive a changing electrical voltage (or current) signal). The derived electrical signal closely corresponds to the frequency, amplitude and/or other characteristics of the acoustic pressure 604 incident to the membrane 602.

At 810, the electrical signal derived at 808 above is amplified and/or processed as needed for further use such as, for non-limiting example, recording, spectral analysis, content identification, etc. In the ongoing example, the signal is assumed to be subject to pre-amplification, digitally quantized, and then recorded on computer-accessible storage media for later analysis.

In general, the foregoing description is intended to be illustrative and not restrictive. Many embodiments and applications other than the examples provided would be apparent to those of skill in the art upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, it should be understood that the invention is capable of modification and variation and is limited only by the following claims.

| Master Legend for All Drawings | |
|---|---|
| 100 | microphone |
| 102 | membrane |
| 104 | vent |

-continued

| Master Legend for All Drawings | |
|---|---|
| 106 | spine |
| 108 | flexure layer |
| 110 | hinge portion |
| 112 | flexure |
| 200 | flexure layer |
| 202 | plate |
| 204 | hinge portion |
| 206 | edge |
| 208 | supporting structure |
| 210 | acoustic pressure |
| 212 | double arrow |
| 214 | flexible extension |
| 216 | edge |
| 218 | piezoresistive sensors |
| 300 | flexure layer |
| 302 | plate |
| 304 | flexible extension |
| 306 | piezoresistive sensor |
| 308 | support structure |
| 310 | hinge portion |
| 312 | edge |
| 314 | acoustic pressure |
| 316 | double arrow |
| 400 | flexure layer |
| 402 | hinge portion |
| 404 | flexible extension |
| 406 | piezoresistive sensor |
| 408 | support structure |
| 410 | plate |
| 412 | edge |
| 414 | edge |
| 416 | acoustic pressure |
| 418 | double arrow |
| 500 | flexure layer |
| 502 | hinge portion |
| 504 | flexible extension |
| 506 | piezoresistive sensor |
| 508 | support structure |
| 510 | plate |
| 512 | edge |
| 514 | edge |
| 516 | acoustic pressure |
| 518 | double arrow |
| 600 | microphone |
| 602 | membrane |
| 604 | acoustic pressure |
| 606 | spine layer |
| 608 | flexure layer |
| 610 | hinge portion |
| 612 | flexible extension |
| 614 | substrate |
| 616 | acoustic cavity |
| 618 | passageway |
| 620 | vent |
| 700 | system |
| 702 | microphone |
| 704 | amplifier |
| 706 | signal processing |
| 708 | acoustic pressure |

What is claimed is:

1. An apparatus, comprising:

a flexure layer defining a plate and a first hinge portion and a second hinge portion, the flexure layer also defining a flexible portion extending away from the plate and configured to exhibit a varying electrical characteristic responsive to an acoustic pressure, wherein the first hinge portion and the second hinge portion are configured to exhibit torsional strain responsive to an acoustic pressure, the first hinge portion and the second hinge portion respectively configured to torsionally couple the plate to a support structure, the flexible portion configured to flexibly couple the plate to the support structure.

2. The apparatus according to claim 1, the plate being square or rectangular or trapezoidal in shape.

3. The apparatus according to claim 1, the first hinge portion and the second hinge portion extending away from respective opposite sides of the plate.

4. The apparatus according to claim 1, the first hinge portion and the second hinge portion at least partially defined by respective curvaceous portions.

5. The apparatus according to claim 1, the support structure and the flexure layer including the plate and the first hinge portion and the second hinge portion and the flexible portion being formed from a monolithic semiconductor layer.

6. The apparatus according to claim 1 further comprising:

a spine layer bonded to the flexible layer; and a membrane layer bonded to the spine layer.

7. The apparatus according to claim 6, the spine layer covering that portion of the flexure layer including neither the first hinge portion nor the second hinge portion nor the flexible portion.

8. The apparatus according to claim 7, the spine layer defined by a first area, the membrane layer defined by a second area greater than the first area.

9. The apparatus according to claim 1, the flexible portion including at least one piezoresistive sensor or piezoelectric sensor.

10. A transducer, comprising:

a flexure layer of monolithic material, the flexure layer defining a plate, the flexure layer also defining a first torsional hinge portion and a second torsional hinge portion extending away from opposite sides of the plate, the flexure layer also defining a flexible extension portion, the first torsional hinge portion and the second torsional hinge portion being configured to exhibit torsional strain responsive to an acoustic pressure;

a spine layer covering the plate of the flexure layer; and a membrane layer covering the spine layer, the flexible extension portion configured to exhibit an electrical characteristic varying in accordance with an acoustic pressure incident to the membrane layer, the first torsional hinge portion and the second torsional hinge portion respectively configured to torsionally couple the plate to a support structure, the flexible portion configured to flexibly couple the plate to the support structure.

11. The transducer according to claim 10, the first torsional hinge portion and the second torsional hinge portion and the flexible extension portion respectively configured to mechanically couple the plate of the flexure layer to a support structure.

12. The transducer according to claim 10, the flexible extension portion configured such that the electrical characteristic is a resistance or a voltage varying in accordance with an acoustic pressure incident to the membrane layer.

13. The transducer according to claim 10, the first torsional hinge portion and the second torsional hinge portion at least partially defined by respective curvaceous portions.

14. The transducer according to claim 10 further comprising one or more materials configured to define an acoustic cavity, the plate being supported within the acoustic cavity by way of the first and second torsional hinge portions and the flexible extension portion, the membrane layer defining one or more vents fluidly coupling the acoustic cavity to an ambient environment about the microphone.

* * * * *